US011472653B2

(12) United States Patent
Jones et al.

(10) Patent No.: US 11,472,653 B2
(45) Date of Patent: Oct. 18, 2022

(54) MANUAL OR MOTORIZED STRAPPING MATERIAL DISPENSER WITH INTEGRATED CUTTER

(71) Applicant: Case-N-Cut, Inc., Wilsonville, OR (US)

(72) Inventors: Micheal D. Jones, Portland, OR (US); Jeffrey M. Jones, Wilsonville, OR (US)

(73) Assignee: Case-N-Cut, Inc., Wilsonville, OR (US)

( * ) Notice: Subject to any disclaimer, the term of this patent is extended or adjusted under 35 U.S.C. 154(b) by 256 days.

(21) Appl. No.: 16/799,029

(22) Filed: Feb. 24, 2020

(65) Prior Publication Data

US 2020/0270086 A1 Aug. 27, 2020

Related U.S. Application Data

(60) Provisional application No. 62/809,964, filed on Feb. 25, 2019.

(51) Int. Cl.
*B65H 16/10* (2006.01)
*B65H 35/06* (2006.01)
*B65H 16/00* (2006.01)

(52) U.S. Cl.
CPC ..... *B65H 16/103* (2013.01); *B65H 16/005* (2013.01); *B65H 35/06* (2013.01)

(58) Field of Classification Search
None
See application file for complete search history.

(56) References Cited

U.S. PATENT DOCUMENTS 1,726,883 A * 9/1929 Brooks ..... B65H 35/0046 83/410.8
2,135,767 A * 11/1938 Price ..... A47K 10/36 242/564.1
3,470,781 A * 10/1969 Domeny ..... B65H 35/002 83/436.9
4,199,090 A * 4/1980 Reed ..... B65H 35/002 225/106
4,640,167 A * 2/1987 Stusack ..... B65H 35/04 83/649
2009/0282961 A1* 11/2009 Jones ..... B26D 5/26 83/436.5
2013/0087030 A1* 4/2013 Jones ..... B65H 35/0066 83/282
2015/0013918 A1* 1/2015 Poplawski ..... B65H 35/0026 156/719

(Continued)

*Primary Examiner* — William A. Rivera
(74) *Attorney, Agent, or Firm* — Craig R. Rogers; Simple IP Law, P.C.

(57) ABSTRACT

A strapping material dispenser may include a housing having a hinged door. A roll of strapping material may be received within the housing and fed into contact with an advancing wheel. A portion of the advancing wheel may extend outside the housing to be contacted by a user. Rotation of the advancing wheel dispenses strapping material from the dispenser. A cutting mechanism may be arranged within the housing to cut the strapping material once the desired length has been dispensed from the dispenser. A motor and digital control circuit may be provided to electronically control the advancing wheel and therefore the dispensing of material from the dispenser.

20 Claims, 13 Drawing Sheets

(56) References Cited

U.S. PATENT DOCUMENTS

| | | | | |
|---|---|---|---|---|
| 2017/0197803 | A1* | 7/2017 | Foreman | B65H 49/205 |
| 2019/0256311 | A1* | 8/2019 | Lam | B65H 35/04 |
| 2020/0031602 | A1* | 1/2020 | Sarkissian | B65H 16/005 |

* cited by examiner

| ITEM NO. | PART NUMBER | DESCRIPTION | QTY. |
|---|---|---|---|
| 201 | 95893A218 | THREAD-FORMING TORX SCREW FOR PLASTICS | 5 |
| 202 | LC055J08S | SS136 SPRING, .720IN LNG | 2 |
| 203 | 96001A160 | Torx Rounded Head Thread-Forming Screws for Plastic, 18-8 Stainless Steel, Number 2 Size, 1/2" Long | 15 |
| 204 | 2776K14 | COMFORT GRIP PLASTIC THREE-ARM KNOB | 1 |
| 205 | 92949A265 | 18-8 SS BUTTON-HEAD SOCKET CAP SCREW | 1 |
| 206 | 608-057 | BOTTOM CASE ASSEMBLY | 1 |
| | 608-003 | BOTTOM CASE | 1 |
| | IBLC-032-8 | Molded-in Threaded Inserts, Self-Locking, Blind Threaded - Unified | 1 |
| 207 | 608-005 | TOP COVER | 1 |
| 208 | 608-006 | FLIP COVER | 1 |
| 209 | 608-040 | BLADE ASSEMBLY | 1 |
| | 608-041 | BACK BASE BLADE | 1 |
| | 608-042 | BLADE SPACER | 1 |
| | 607-044 | BLADE | 1 |
| | 92703A109 | STAINLESS STEEL TORX FLAT HEAD SCREW, #2-56 | 7 |
| | 608-045 | BLADE PRESSURE PLATE | 1 |
| | 92703A205 | STAINLESS STEEL TORX FLAT HEAD SCREWS, #4-40 | 2 |
| | 608-066 | FRONT BLADE SUPPORT | 1 |
| 210 | 608-055 | HANDLE | 1 |
| 211 | 608-114 | ADVANCING WHEEL ASSEMBLY | 1 |
| 211a | 608-214 | RUBBER WHEEL OVERMOLD | 1 |
| 211b | 608-114_BM-4 | ADVANCING WHEEL BASE MOLD | 1 |
| 212 | 608-046 | RETURN PLATE | 1 |
| 213 | 608-047 | PUSH PLATE | 1 |
| 214 | 608-056 | BELT CLIP WELDMENT | 1 |
| | 608-023 | BELT CLIP | 1 |
| | 608-062 | 2.5" STANDOFF, 10-32THRDS ON ONE SIDE | 1 |
| 215 | 608-013 | HINGE PIN, FLIP COVER | 1 |

FIG. 15

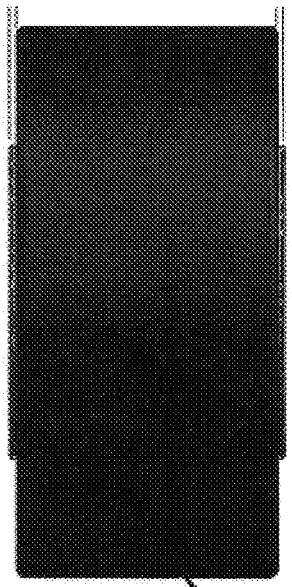
FIG. 18A
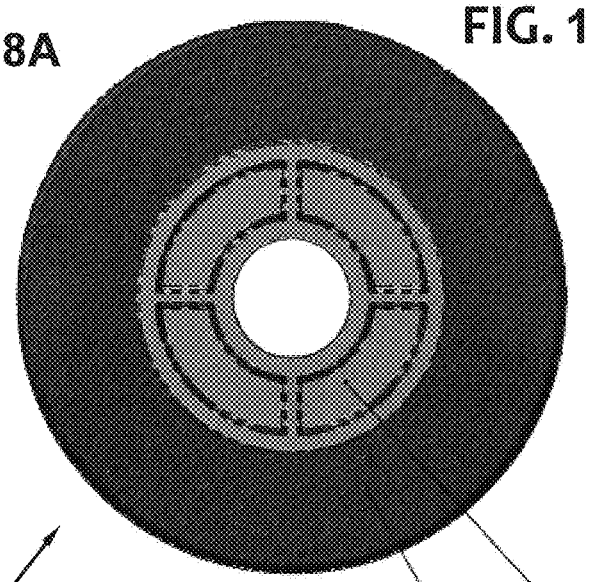
FIG. 18B
211
211b
211a
—MT11090 TEXTURE ON OD
(OR APPROVED EQUIVALENT)
FIG. 19A
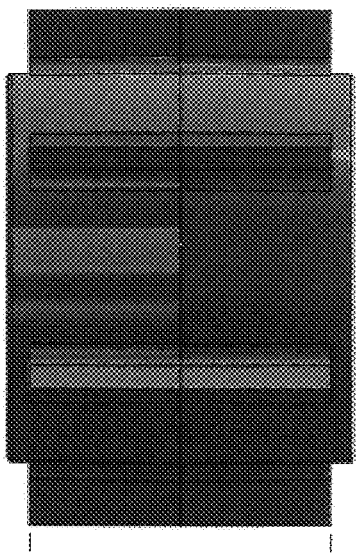
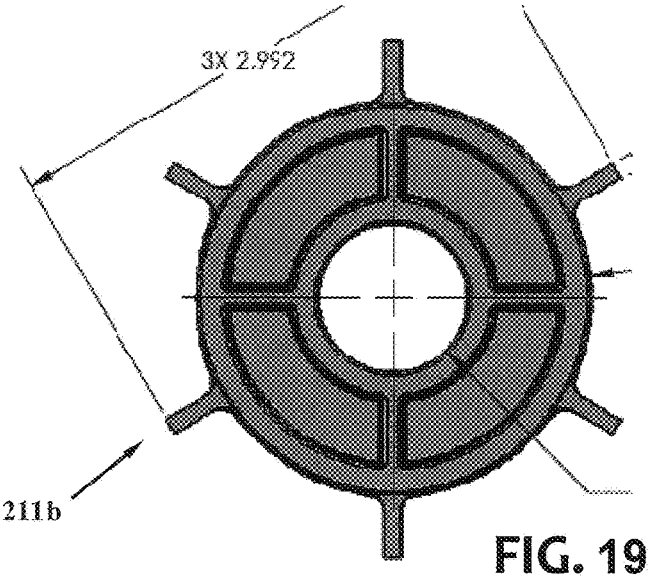
211b
FIG. 19B
| ITEM NO. | PART NUMBER | DESCRIPTION | QTY. |
|---|---|---|---|
| 211a | 608-214 | RUBBER WHEEL OVERMOLD | 1 |
| 211b | 608-114_BM-4 | ADVANCING WHEEL BASE MOLD | 1 |
FIG. 20

MANUAL OR MOTORIZED STRAPPING MATERIAL DISPENSER WITH INTEGRATED CUTTER

PRIORITY CLAIM

This application is a non-provisional of, and claims priority from, U.S. Provisional Patent Application Ser. No. 62/809,964 filed Feb. 25, 2019, the contents of which are hereby incorporated by reference in their entirety.

RELATED INVENTIONS

This application provides improvements and alternative inventions to that shown and described in U.S. Pat. No. 8,881,630, issued Nov. 11, 2014, the contents of which are hereby incorporated by reference in their entirety.

BACKGROUND OF THE INVENTION

Field of the Invention

This invention relates to material dispensers, and specifically to a dispenser suitable for use with flexible material formed in long and relatively thin and narrow strips, suitable for coiling, such as plumber's strapping.

Related Art

Plumber's strapping, also called plumber's "tape" or "hanger strap," is used to secure or suspend water supply lines, and drain, waste, and vent pipes from walls, floors, and framing members. There are two common types of plumber's strapping: plastic strapping and metal strapping. Metal strapping requires the use of fairly heavy snippers to cut the tape to a desired length, which can result in sharp edges, which may easily scratch a user's hands. Thus, metal tape has been largely replaced by a polymer version thereof, which is easier to work with and which is considerably cheaper. Both types generally consist of a strip of approximately one inch wide material having perforations spaced evenly along the length thereof. The polymer strapping is typically sold in tightly coiled rolls and packaged in thin, flexible plastic. While the polymer strapping is less likely to injure a user and is much easier to cut than the metal strapping, upon removal from the packaging, it tends to un-coil and tangle, resulting in user frustration along with waste of material. Mesh or woven strapping material is another alternative to plastic or metal strapping material. Mesh tape may, for instance, be between approximately one-half inch to three inches in width.

What is needed is a means for a user to conveniently store a coil of polymer, metal, or mesh plumber's strapping, or other flexible, coiled material, without the coil becoming loose or tangled, while enabling the user to easily measure and cut a desired length of strapping.

U.S. Pat. No. 8,881,630 (the '630 patent) describes one method for addressing problems in the prior art by providing an improved means for storing, dispensing and cutting plumber's strapping. According to the '630 patent, a dispenser for dispensing a desired amount of material from an amount of stored material includes a housing having a material track, a material storage area, a material-advancement mechanism disposed within said housing, a material-cutting mechanism disposed within the housing, and an actuator. The actuator has a first end operatively engaged with the material-advancement mechanism and an opposing second end operatively engaged with the material-cutting mechanism. The actuator is spring-biased to a standby position via at least one spring and is movable between the extended position, a material-advancement position, and a material-cutting position. Moving the actuator from the extended position to the material advancement position engages the material advancement mechanism. Moving the actuator into the material cutting position engages the cutting mechanism.

Numerous other benefits and advantages could be provided through alternative devices providing a material dispenser with integrated cutting ability. The principles of the present inventive concepts provide some such devices.

SUMMARY OF THE INVENTION

According to various embodiments and principles of the present inventive concepts, a strapping material dispenser with integrated cutter can provide numerous additional improvements over the prior art, including, for instance, a user-actuated roller mechanism for advancing material, and/or a programmable digital delivery system with motorized advancing mechanism for automatically providing a desired amount of strapping material to a user.

According to one aspect of the present inventive concepts, a manual strapping material dispenser includes a housing configured to house a roll of strapping material. The housing may have a hinged door that opens to receive the roll of strapping material. An advancing wheel is provided in the housing to contact the strapping material and advance it towards a cutting mechanism. The cutting mechanism may be actuated by a handle or grip member. At least a portion of the advancing wheel may extend outside the housing to be contacted by a user.

In operation, the roll of strapping material is arranged within the housing and the strapping material is fed into contact with the advancing wheel before the door is closed. The door may be secured in the closed position by a knob, screw, or other fastening device. The advancing wheel is preferably a rubberized wheel having a texture that grips the strapping material to advance it along a track within the housing towards the cutting mechanism. The user contacts the advancing wheel to rotate it, causing a desired amount of strapping material to advance from the dispenser. Once the desired amount of strapping material has been advanced, the user squeezes a handle to actuate the cutting mechanism and cut the strapping material in the desired length.

According to another embodiment of the present inventive concepts, the advancing wheel may be controllable by an electric motor in addition to, or instead of, manual user actuation. A control circuit may be provided to control the motor in response to user programming. A digital control panel may be arranged on an outside of the housing to permit a user to program the control circuit or otherwise actuate the motor. For instance, a user may program the control circuit to advance a predetermined length of strapping material. The user can then press a button to cause the motor to advance the selected length of material. Once the material has been advanced, the user squeezes the handle (or trigger) to cut the material having the desired length. By programming the digital control circuit, a consistent length of material can be readily advanced and cut.

Various aspects, embodiments, and configurations of this invention are possible without departing from the principles disclosed herein. This invention is therefore not limited to any of the particular aspects, embodiments, or configurations described herein.

BRIEF DESCRIPTION OF DRAWINGS

The foregoing and additional objects, features, and advantages of the present invention will become more readily apparent from the following detailed description of preferred embodiments, including the following drawings, in which:

FIG. 15 is a parts list identifying the components labeled in FIG. 14;

FIGS. 18A and 18B are somewhat schematic side and front views, respectively, of an advancing wheel for the strapping material dispenser according to embodiments of the present inventive concepts;

FIGS. 19A and 19B are somewhat schematic side and front views, respectively, of a base mold for the advancing wheel; and FIG. 20 is a parts list for the advancing wheel assembly of FIGS. 18A-19B.

DETAILED DESCRIPTION OF ILLUSTRATIVE EMBODIMENTS

Figure 1:
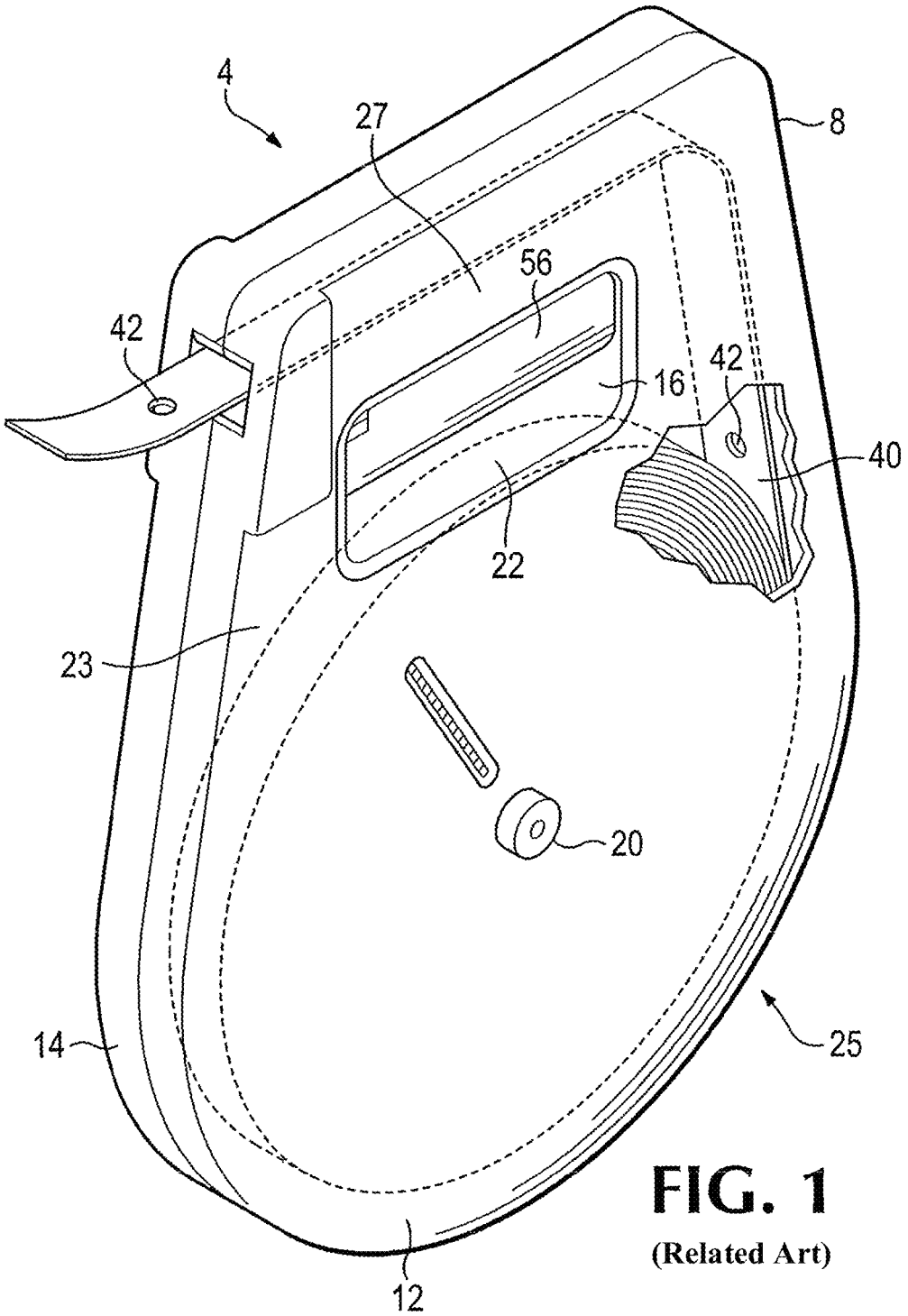
FIG. 1 (Related Art)
FIG. 1 is an isometric view of an embodiment of the material dispenser of the related art, with a portion broken away to show detail.

Various features, benefits, and configurations incorporating the principles of the present inventive concepts in illustrative embodiments are shown in the accompanying drawings. Additional features, benefits and configurations will be readily apparent to those of ordinary skill in the art based on this disclosure, and all such features, benefits and configurations are considered within the scope of the present invention. The related art and various illustrative embodiments will now be described in further detail in connection with the accompanying drawings.

FIGS. 1-9 are taken from the '630 patent and illustrate the related art. Referring to FIGS. 1-9, an embodiment of a material dispenser 4 according to the related art includes a clam-shell like case 8 including shell halves 12 and 14, which may be held together by a fastener, such as nut-and-bolt combination 20. The shell halves 12, 14 are formed with matching openings such that when the dispenser 4 is assembled, a single opening 16 is provided to allow gripping of the dispenser 4. The dispenser 4 is divided into a material storage section 25, below the opening 16, and a material advancement and cutting section 27, above the opening 16. In use, a roll of material 40 to be selectively dispensed is placed in the case 8 and threaded through a material track 44 therein, after which the halves are fastened together. The material 40 may be an injection molded solid, woven material, or any suitably flexible material formed in long and relatively thin and narrow strips, suitable for coiling, and may further have perforations 42, such as the Plastic Plumbers Tape, manufactured by the William H. Harvey Company of Omaha, Nebr.

The material track 44 is defined by a lower track guide 45 and an upper track guide 46, disposed adjacent to one another in the material advancement and cutting section 23. A material advancement mechanism 48 and a material cutting mechanism 52 are secured to the rear and forward ends of the upper and lower track guides respectively. Both mechanisms 48, 52 are in communication with a dual-purpose actuator 56 captured in the case 8 below the lower track guide 45 and extending into the opening 16.

In the embodiment shown in the drawings, the actuator 56 is biased to an extended position by a material advancement spring 60 and a cutter return spring 64, which extend between the actuator 56 and the lower track guide 45. The actuator 56 has a generally u-shaped cross section for receiving other elements of the dispensing and cutting mechanisms therein and is selectively shiftable between an extended position, shown in FIGS. 2-5, a material advancement position, shown in FIG. 6, and a material-cutting position, shown in FIG. 7.

The actuator 56 is operable to move a rack plate 72, located at rear end of the actuator, in the direction of arrow 80. The actuator 56 is connected to the rack plate 72 via a connection pin 84. The movement of the connection pin 84, and thus the rack plate 72, is constrained to a limited path by a guide slot 88 formed in the lower track guide 45. The rack plate 72 has an internal perimeter surface including a rack 96. The rack 96 is engaged with a dispensing roller assembly 100, including a pinion wheel 104, a pawl wheel 108, a dispensing roller 110, and an axle pin 112, all rotatable about a common axis defined by the axle pin. The pinion wheel 104 is disposed adjacent to the dispensing roller 110 and the pawl wheel 108 is disposed partially within both the pinion wheel and the dispensing roller. The pawl wheel 108 includes drive members 113 engaged with the pinion wheel 104 and pawls 114 engaged with a ratchet-toothed inner surface 116 of the dispensing roller 110.

Figure 2:
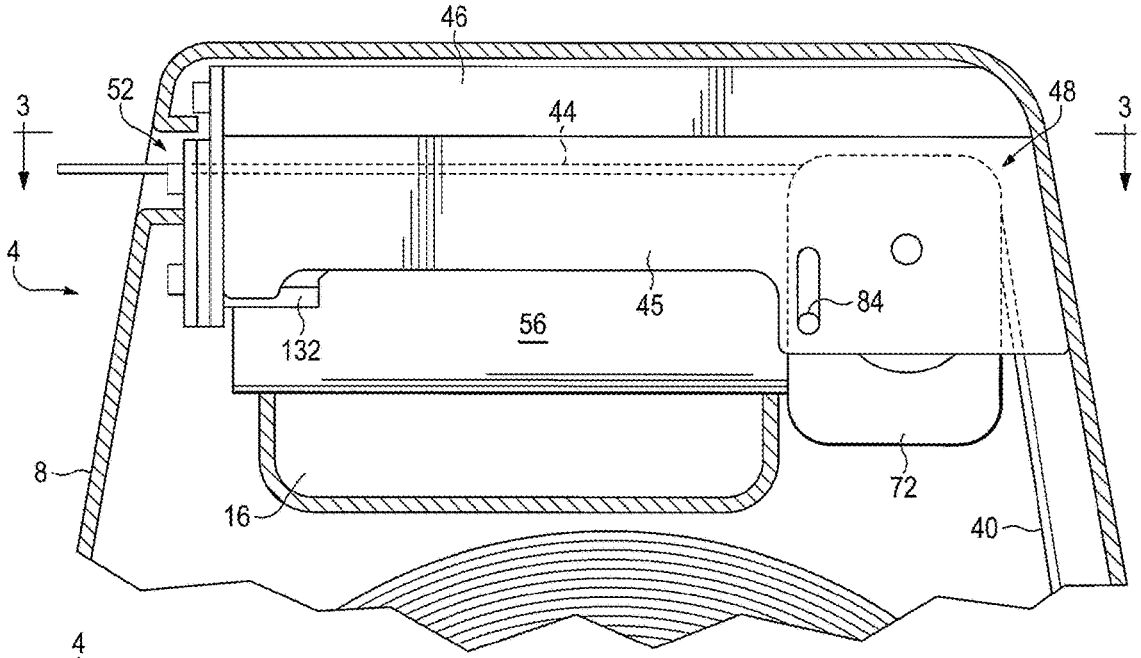
FIG. 2 (Related Art)
FIG. 2 is a partial side elevation view of the material dispenser of FIG. 1, with the trigger handle thereof shown in a standby position.
Figure 6:
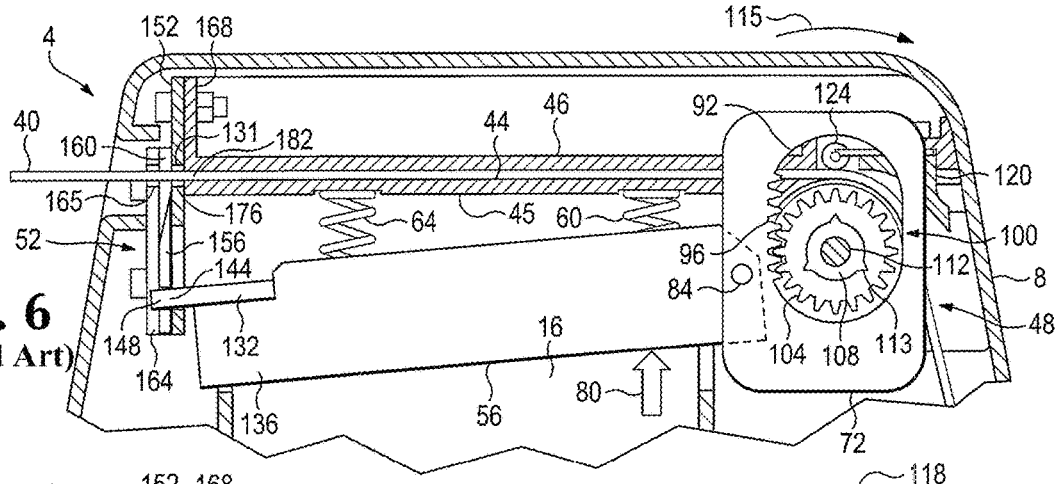
FIG. 6 (Related Art)
FIG. 6 is a view similar to FIG. 4, but with the activation handle shown in a material advancement position.

When an appropriate external force is applied to the actuator 56, such as from a user gripping the actuator and squeezing its rear end, the actuator moves from the position shown in FIG. 2 toward the position shown in FIG. 6. The movement of the actuator 56 loads the material advancement spring 60 and causes the rack plate 72 to move in the direction of arrow 80 along the limited path defined by the guide slot 88. The rack 96 is engaged with the pinion wheel 104 and thus the movement of the rack plate 72 causes the pinion wheel to rotate in a clockwise, loading direction, indicated by arrow 115. The rotation of the pinion wheel 104 in turn rotates the pawl wheel 108 via the drive members 113. The pawls 114 and teeth 117 are oriented so that the pawls do not engage the teeth when the pawl wheel 110 rotates in the loading direction and therefore the dispensing roller remains stationary. However, when the external force is removed from the actuator 56 the material advancement spring 60 will tend to return to its extended state, causing the actuator 56 to return elastically towards the standby position shown in FIG. 2. The rack 96 engages the pinion wheel 104, causing the pinion wheel and the pawl wheel 108 to rotate in a counter-clockwise, material advancement direction, indicated by the arrow 119 in FIG. 5. The pawl members 114 now engage with the inner surface 116 of the dispensing roll 110, causing the dispensing roll to coaxially rotate along with the pinion wheel 104 and pawl wheel 108 in the counter-clockwise, advancement direction 119.

The dispensing roller 110 may be fabricated in a manner to facilitate gripping of the material 40, such as by having a textured outer surface 118 to provide frictional contact between the dispensing roller 110 and the material 40. Alternatively, the dispensing roller may further be provided with protrusions (not shown) for interdigitating with perforations 42 in the material 40. Advancement of the material 40 is further facilitated by a directional guide member 120 and a pressure roller 124 located adjacent to the upper track guide 46. The directional guide member 120 directs a leading section of material 40 between the dispensing roller 110 and the pressure roller 124. The pressure roller 124 is biased towards dispensing roller 110 by a spring 130 in order to maintain the material 40 in frictional contact with the dispensing roller 110. Rotation of the dispensing roller in the advancement direction will cause a corresponding advancement of the material 40 along the track 44, through an opening 131 at the end of the track, toward cutting mechanism 52.

Figure 7:
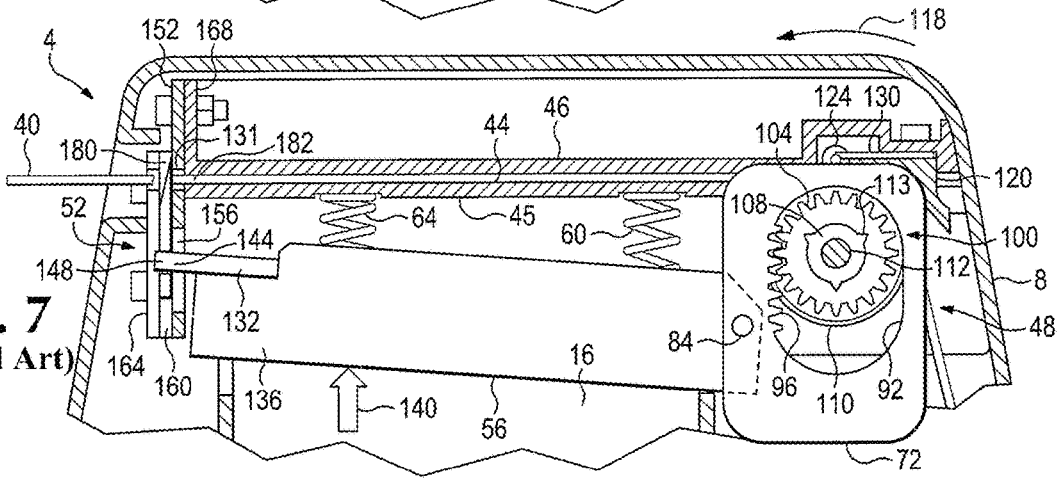
FIG. 7 (Related Art)
FIG. 7 is a view similar to FIG. 6, but with the activation handle shown in a material cutting position.
Figures 8, 9:
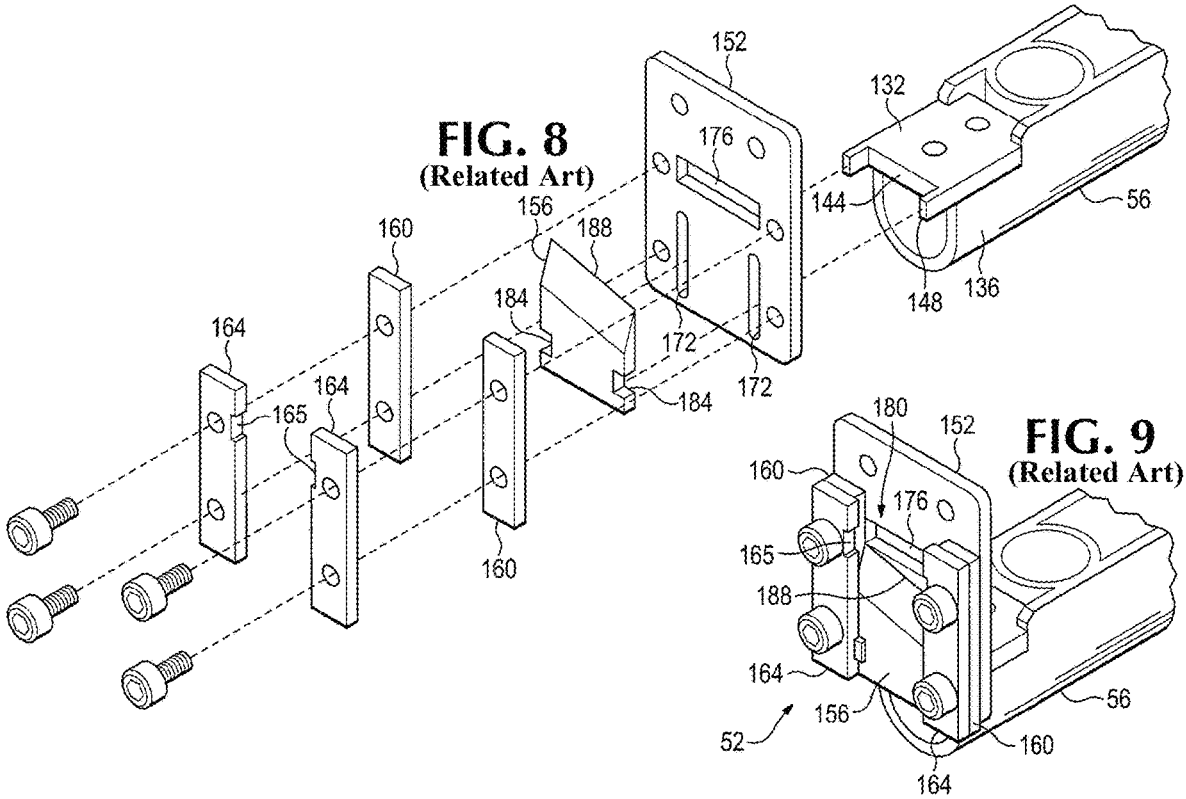
FIG. 8 (Related Art)
FIG. 9 (Related Art)
FIG. 8 is an exploded perspective view showing the components of a cutting mechanism of the material dispenser of FIG. 1.
FIG. 9 is a perspective view showing the cutting mechanism shown in FIG. 8 in its assembled configuration.
Figure 10:
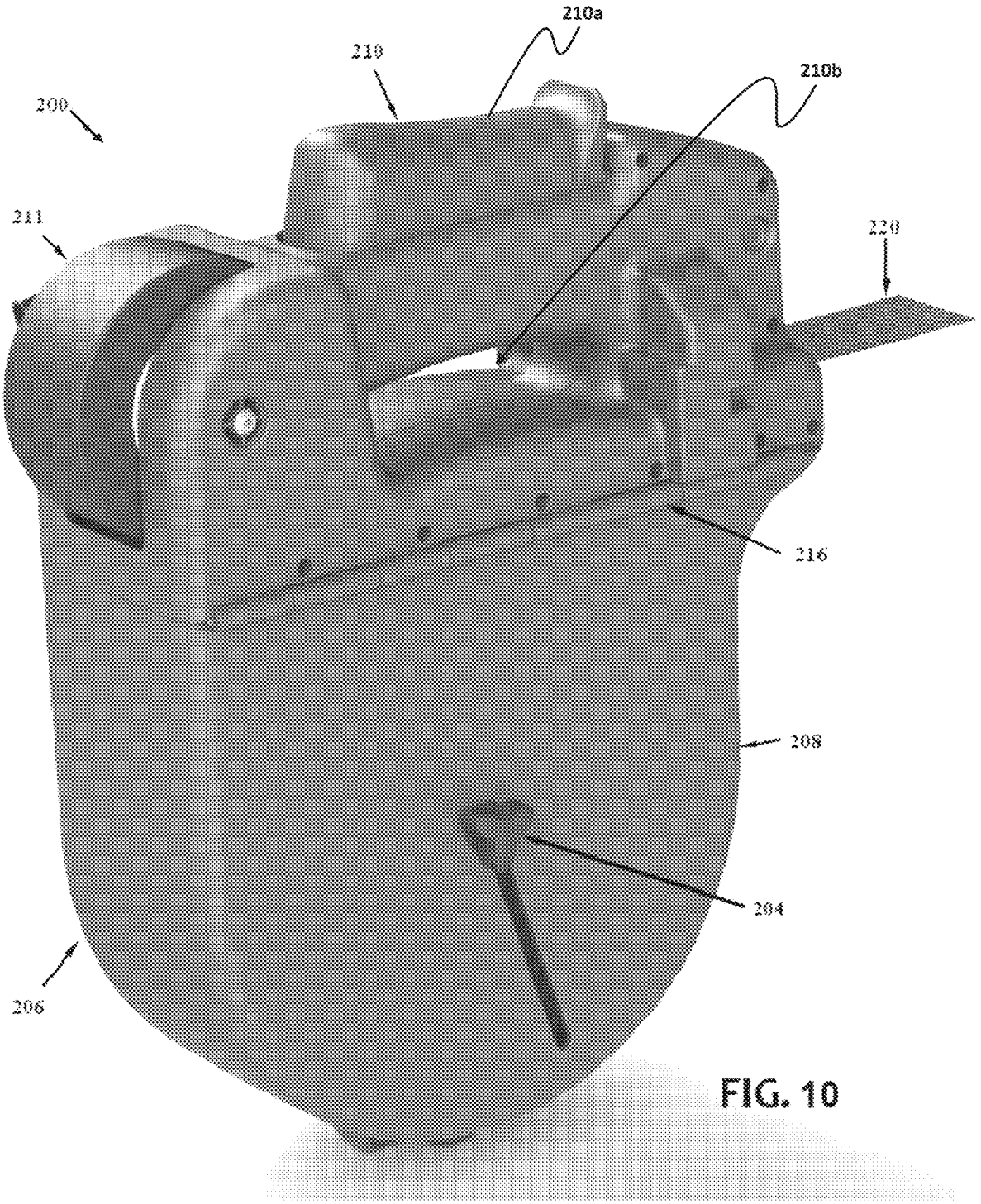
FIG. 10 is a perspective view of a manual strapping material dispenser with integrated cutter according to principles of the present inventive concepts.
Figure 11:
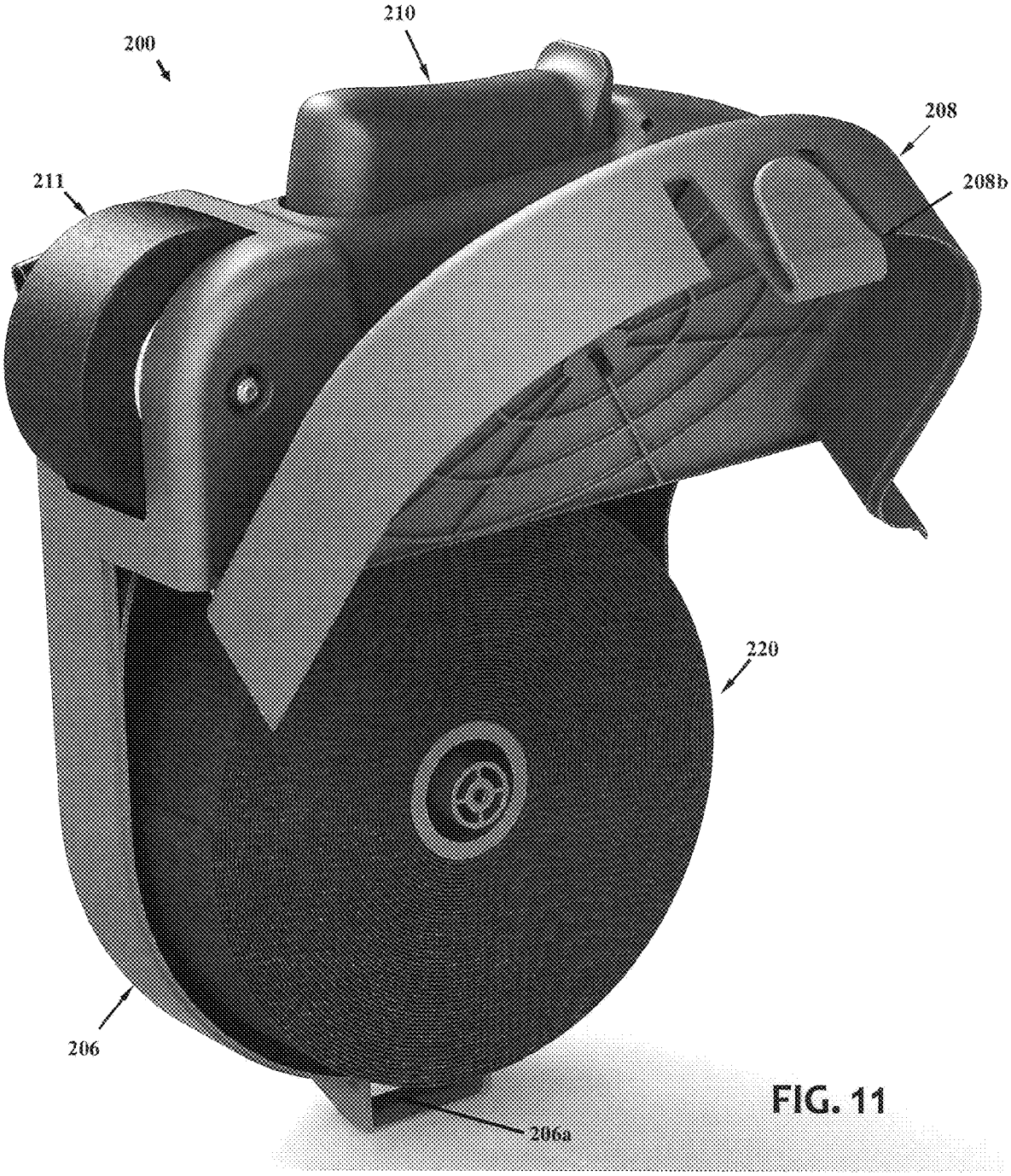
FIG. 11 is a perspective view of the manual strapping material dispenser of FIG. 10, shown with a housing door arranged in an open position to illustrate the operation of the door and the arrangement of the strapping material within the dispenser.
Figure 12:
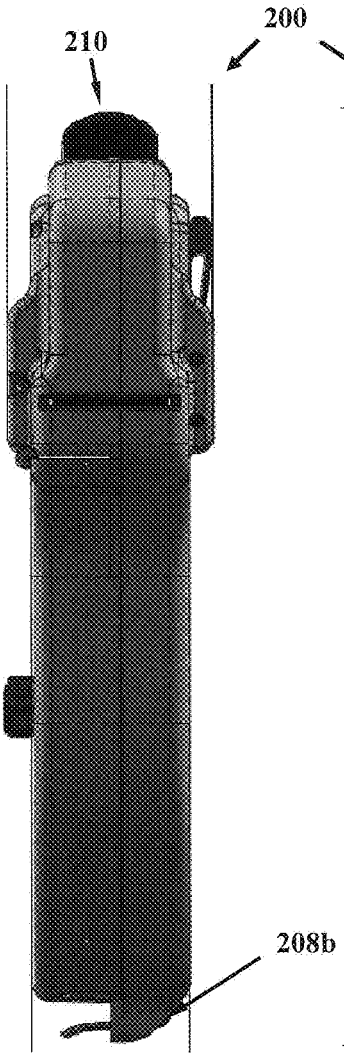
FIG. 12 is a somewhat schematic side view of the strapping material dispenser of FIG. 10.
Figure 13:
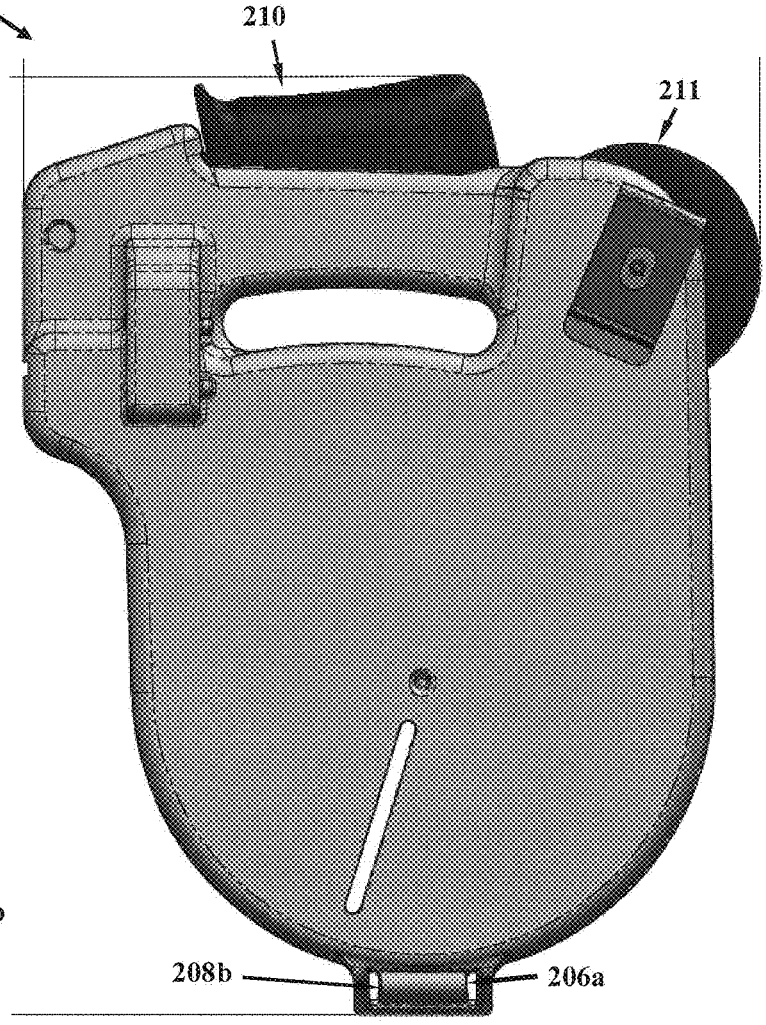
FIG. 13 is a somewhat schematic rear view of the strapping material dispenser of FIG. 10.
Figure 14:
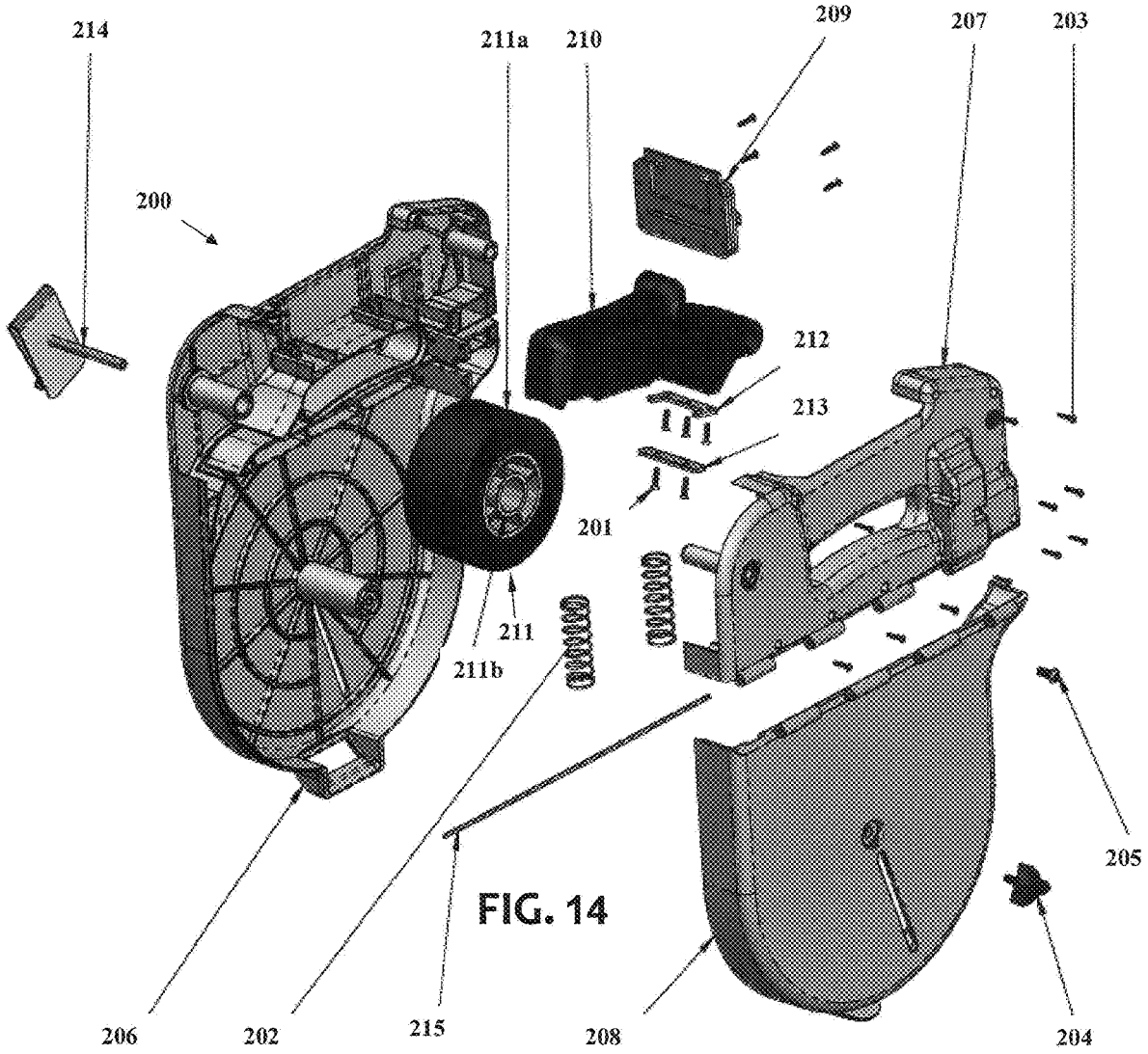
FIG. 14 is a somewhat schematic exploded perspective view of the strapping material dispenser of FIG. 10.

Referring to FIGS. 4, and 7-9, actuator 56 is further operable to move a drive member 132, located at a forward end 136 of the actuator 56, in the direction of arrow 140 in FIG. 7. A forward end 144 of the drive member 132 is engaged with the material cutting mechanism 52 via engagement members 148 formed in the drive member. The material cutting mechanism 52 includes a blade guide plate 152, a blade 156, a pair of blade guide spacers 160, and a pair of blade retention members 164. The blade retention members also define material guide notches 165 that can help constrain the material 40 as it is being cut by the blade 156. The components of the material cutting mechanism 52 are preferably made of stainless steel, or a similarly durable, corrosion resistant material. The mechanism 52 is affixed to a forward end 168 of the upper track guide 46. The blade guide plate 152 is fashioned to define two guide slots 172, for aligning the engagement members with the blade 156, and a material passageway 176. The blade guide plate 152, the pair of blade guide spacers 160, and the pair of blade retention members 164 form a limited travel path 180 for the blade 156. The mechanism 52 is positioned such that the material passageway 176 is aligned with an opening 182 at the end of the track 44. The blade 156 is formed with a pair of guide notches 184 and a cutting edge 188 and is located adjacent to the blade guide plate 152 and between the blade guide spacers 160. When the actuator 56 is in the stand-by position, the cutting edge 188 is disposed adjacent to material passageway 176. The engagement members 148 pass through the guide slots 172 and engage the blade 156 via guide notches 184.

Figure 3:
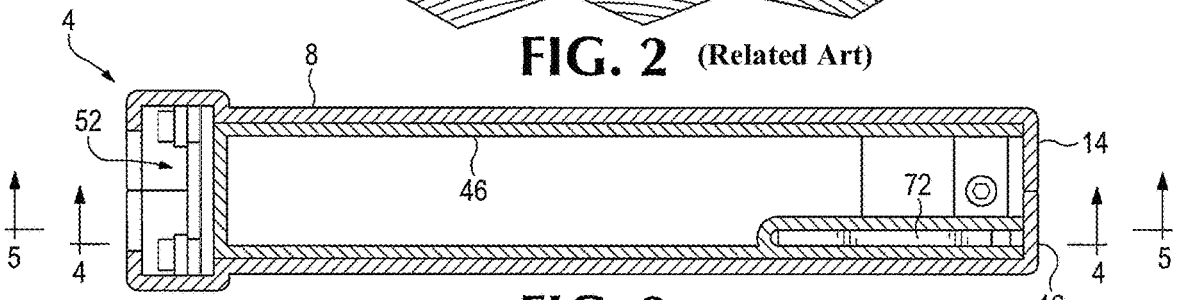
FIG. 3 (Related Art)
FIG. 3 is a top down cutaway view of the material dispenser of FIG. 2 from the plane labeled 3-3 therein.
Figure 4:
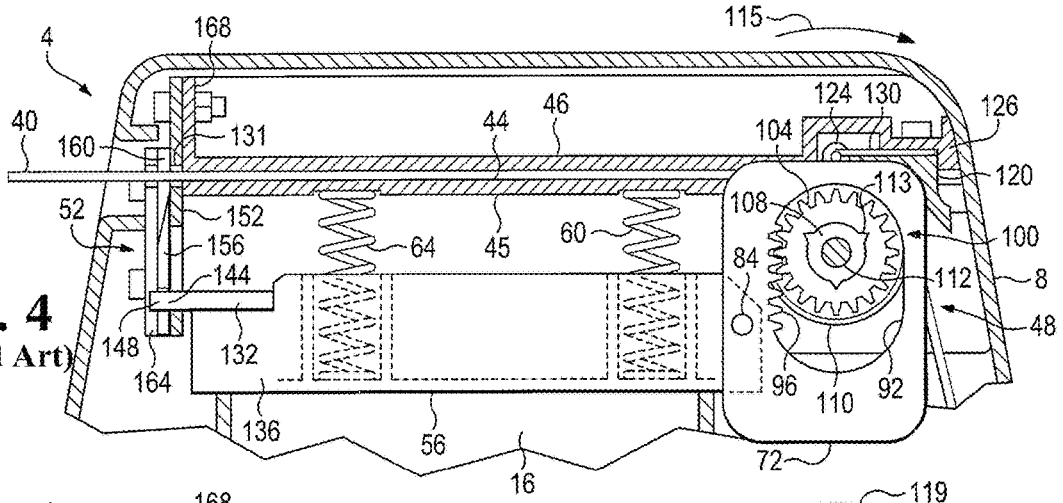
FIG. 4 (Related Art)
FIG. 4 is a view similar to FIG. 2, but cut away along line 4-4 of FIG. 3 to illustrate the interior of the material advancement mechanism and the cutting mechanism.
Figure 5:
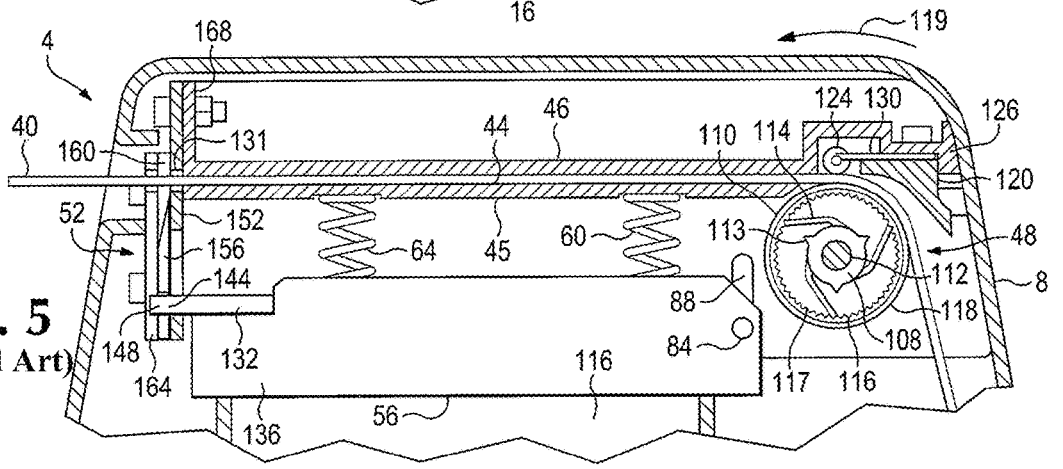
FIG. 5 (Related Art)
FIG. 5 is a view similar to FIG. 4, but cut away along line 5-5 of FIG. 3 to further illustrate the interior of the material advancement mechanism and the cutting mechanism.

Referring to FIG. 7, when an appropriate external force is applied to the actuator 56, such as by a user gripping the actuator and squeezing the front end, the actuator is moved from the position shown in FIGS. 2 and 3, toward the position shown in FIG. 7. The movement of the trigger 56 loads the material return spring 64 and causes the blade 156 to travel in the direction of arrow 140. The cutting edge 188 will move past the material passageway 176, severing any portion of the material 40 that extends beyond the passageway.

FIGS. 10-20 illustrate various embodiments of a strapping material dispenser according to principles of the present inventive concepts. The principles of the present inventive concepts can simplify and improve the construction and operation of the strapping material dispenser provided by the related art.

Referring first to FIGS. 10-15 and 18A-20, according to one aspect of the present inventive concepts, a manual strapping material dispenser 200 includes a housing 206 configured to house a roll of strapping material 220. The housing 206 may have a hinged door 208 that opens to receive the roll of strapping material 220. An advancing wheel 211 is provided in the housing 206 to contact the strapping material 220 and advance it towards a cutting mechanism 209. The cutting mechanism 209 may be actuated by a handle or grip member 210 that includes a trigger **210*a* configured to contact a user's palm and a hole 210*b* arranged through the housing 206 to receive a user's fingers for gripping the handle 210. At least a portion of the advancing wheel 211 may extend outside the housing 206** to be contacted by a user.

In operation, the roll of strapping material 220 is arranged within the housing 206 and the strapping material 220 is fed into contact with the advancing wheel 211 before the door 208 is closed. The door 208 may include a hinge 216 to permit it to swing open and closed, and may be secured in the closed position by a knob, screw, or other fastening device 204. A clip **208*b* may also be provided to snap into a receiving hole 206*a* in the housing to hold the door 206 in a closed position until the clip 208*b* is released. The advancing wheel 211 preferably comprises a rubberized wheel 211*a* (such as 50 Shore A Rubber) having a texture (such as MT11090 texture) on its outside diameter that grips the strapping material 220 to advance it along a track within the housing 206 towards the cutting mechanism 209. The user contacts and rotates the advancing wheel 211 to cause a desired amount of strapping material 220 to advance from the dispenser 200. Once the desired amount of strapping material 220 has been advanced, the user squeezes a handle (trigger) 210 to actuate the cutting mechanism 209 and cut the strapping material 220** in the desired length.

Figure 16:
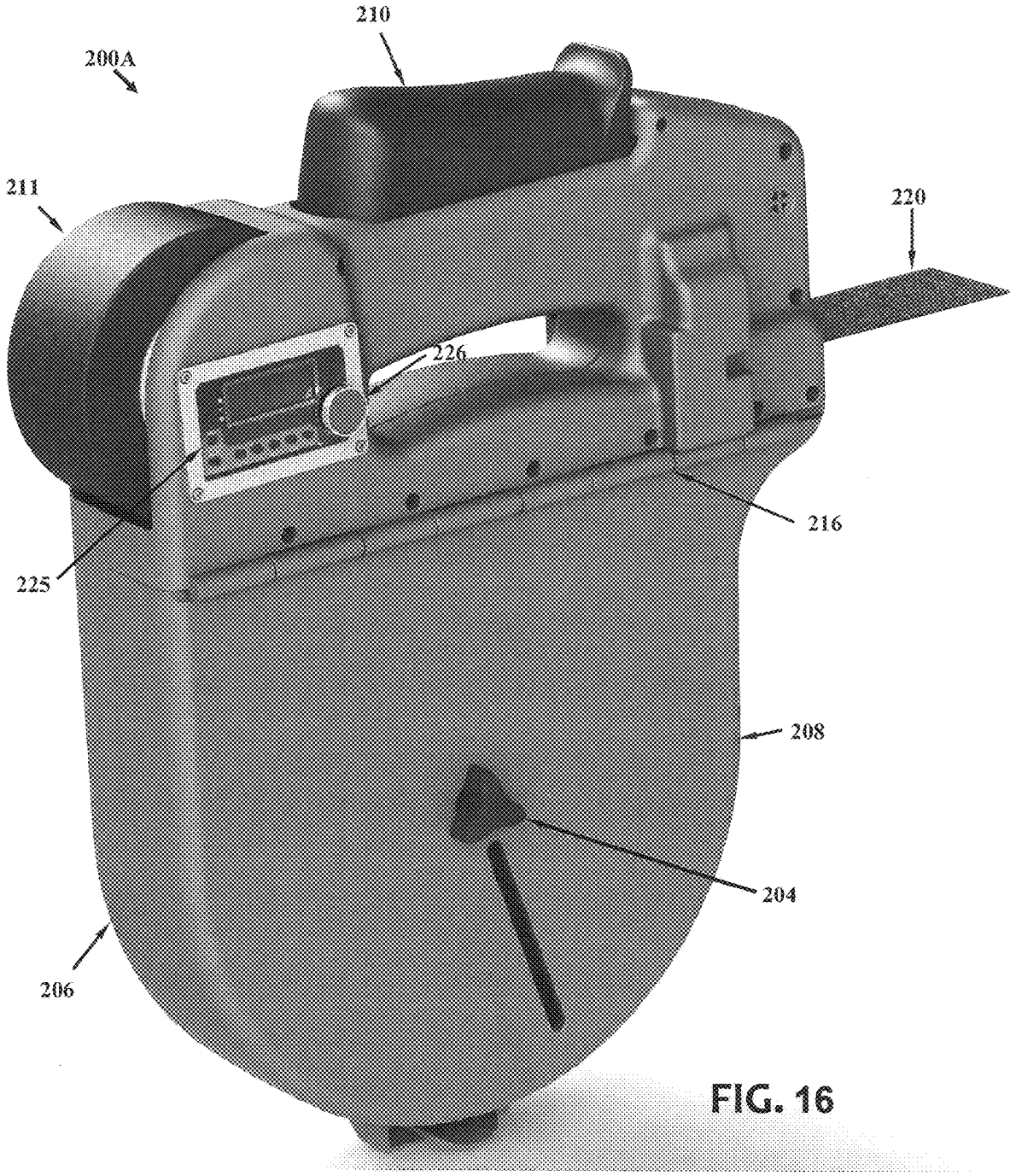
FIG. 16 is a somewhat schematic perspective view of a motorized strapping material dispenser according to another embodiment of the present inventive concepts.
Figure 17:
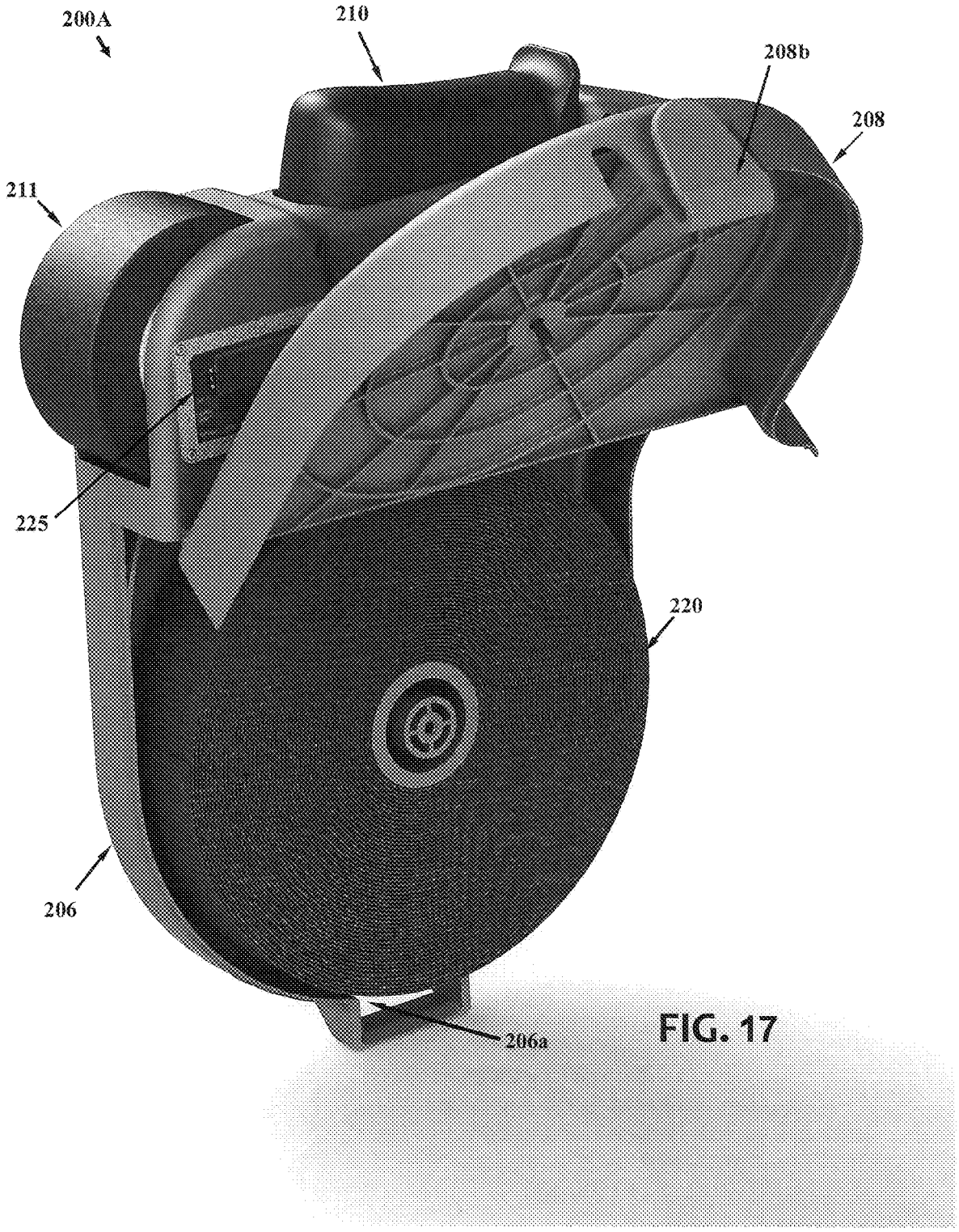
FIG. 17 is a somewhat schematic perspective view of the motorized strapping material dispenser of FIG. 16, shown with a door in an open position to illustrate the operation of the door and the positioning of the strapping material within the dispenser.

Referring now to FIGS. 16 and 17, according to another embodiment of the present inventive concepts, the advancing wheel 211 of a material dispenser 200A may be controllable by an electric motor (not shown) in addition to, or instead of, manual user actuation. The electric motor may, for instance, be connected directly to the advancing wheel 211 or may be connected through a series of gears. A control circuit (not shown) may be provided to control the motor in response to user programming. A digital control panel 225 may be arranged on an outside of the housing 206 to permit a user to program the control circuit or otherwise actuate the motor. For instance, a user may program the control circuit using the control panel 225 to advance a predetermined length of strapping material 220. The user can then press a button 226 to cause the motor to advance the selected length of material 220. Once the material 220 has been advanced, the user squeezes the handle (or trigger) 210 to cut the material 220 having the desired length. By programming the digital control circuit using the digital control panel 225, a consistent length of material 220 can be readily advanced and cut.

In one alternative mode of operation, the user could be provided with the option of pressing a button 226 to advance material 220. By pressing the button 226, the user can be permitted to actuate the motor and continue advancing material 220 until the button 226 is released. The user then squeezes the handle 210 to cut the material 220 having the desired length.

The user could also be provided with the ability to manually advance material 220 using the advancing wheel 211. The user could contact a portion of the advancing wheel 211 that protrudes from the housing 206 to manually rotate the advancing wheel 211 and advance a desired length of strapping material 220. Once the desire length of material 220 has been advanced, the user squeezes the handle 210 to actuate the cutting mechanism 209 and cut the strapping material 220 in the desired length.

Having described and illustrated principles of the present inventive concepts in various preferred embodiments thereof, it should be apparent that the invention can be modified in arrangement and detail without departing from such principles.

What is claimed is:

1. A strapping material dispenser comprising:

a housing configured to house a quantity of flexible strapping material;

a cutting mechanism arranged within the housing and configured to cut the strapping material at a desired position;

a handle located on a topmost portion of the housing and having a trigger arranged to contact a palm of a user's hand and to actuate the cutting mechanism in response to a user squeezing the handle;

an advancement wheel arranged in the housing to contact the strapping material and feed the strapping material through the cutting mechanism; and wherein at least a portion of the advancement wheel extends outside the housing such that it may be rotated through contact by the user to advance the strapping material.

2. The strapping material dispenser according to claim 1, further comprising:

a motor arranged in the housing and configured to advance the advancement wheel in response to user input; and a digital control circuit configured to control the motor based on input from the user.

3. The strapping material dispenser according to claim 2, further comprising a digital control panel arranged in the housing to permit a user to input instructions to the digital control circuit.

4. The strapping material dispenser of claim 3, wherein the digital control panel permits a user to select a predetermined length of strapping material to advance automatically from the dispenser.

5. The strapping material dispenser of claim 4, further comprising a button that causes the dispenser to automatically dispense the predetermined length of strapping material in response to user activation of the button.

6. The strapping material dispenser according to claim 2, further comprising a button configured to cause the motor to advance material while the button is actuated.

7. The strapping material dispenser according to claim 1, further comprising a hinged door that opens to permit placement of the flexible strapping material within the housing.

8. The strapping material dispenser of claim 7, further comprising a knob that fastens to the housing to retain the door in a closed position.

9. The strapping material dispenser of claim 7, further comprising a clip and hole arranged in the housing and door to retain the door in a closed position until the clip is released from the hole.

10. The strapping material dispenser of claim 7, wherein the hinge for the hinged door comprises a hinge pin that extends through hinge holes arranged along substantially the entire width of the housing.

11. A strapping material dispenser comprising:

a housing configured to house a roll of strapping material;

a trigger mechanism located on a handle arranged at a topmost portion of the housing and configured to contact a user's palm and actuate in response to a squeezing action by a user's hand;

a cutting mechanism arranged in the housing and configured to cut the strapping material in response to user actuation of the trigger mechanism; and an advancing wheel positioned within the housing and having a portion of the advancing wheel that extends beyond the housing to be contacted by a user, wherein the advancing wheel is configured to contact strapping material from the roll of strapping material to advance the strapping material from the housing.

12. The strapping material dispenser according to claim 11, further comprising a door hingedly connected to the housing and configured to open to permit positioning of the roll of strapping material within the housing.

13. The strapping material dispenser according to claim 12, further comprising a clip and hole arranged on the door and housing, respectively, wherein the clip snaps into the hole to retain the door in a closed position until released by a user.

14. The strapping material dispenser according to claim 12, further comprising a knob configured to fasten to the housing to retain the door in a closed position.

15. The strapping material dispenser according to claim 11, further comprising a motor arranged in the housing and configured to advance the advancement wheel in response to user input.

16. A strapping material dispenser comprising:

a housing configured to house a roll of strapping material;

a trigger mechanism located on a handle arranged at a topmost portion of the housing and configured to contact a user's palm and actuate in response to a squeezing action by a user's hand;

a cutting mechanism arranged in the housing and configured to cut the strapping material in response to actuation of the trigger mechanism;

an advancing wheel positioned within the housing and configured to contact strapping material from the roll of strapping material to advance the strapping material from the housing; and a motor configured to actuate the advancing wheel to feed the strapping material from the housing.

17. The strapping material dispenser according to claim 16, further comprising a digital control panel and digital circuit configured to control operation of the motor to control the feeding of strapping material from the housing.

18. The strapping material dispenser according to claim 17, wherein the digital control panel permits a user to select a predetermined amount of strapping material to automatically advance from the dispenser.

19. The strapping material dispenser according to claim 18, further comprising a button that causes the dispenser to automatically dispense the predetermined amount of strapping material in response to user activation of the button.

20. The strapping material dispenser according to claim 16, further comprising a button that permits a user to control the motor to feed strapping material from the housing.

* * * * *